US006025779A

United States Patent [19]

Huang

[11] Patent Number: 6,025,779

[45] Date of Patent: Feb. 15, 2000

[54] ALARM SYSTEM

[76] Inventor: Dennis Huang, 5F, No, Lane 9, Ningpo E. St., Taipei, Taiwan

[21] Appl. No.: 09/193,416

[22] Filed: Nov. 18, 1998

[51] Int. Cl.[7] ..... G08B 1/00

[52] U.S. Cl. ..... 340/539; 340/573.1; 340/573.4; 340/539; 340/534; 340/527; 340/529; 340/825.36; 340/825.69; 340/825.72; 109/38; 455/38; 455/404; 455/38.2; 455/507

[58] Field of Search ..... 340/539, 573.1, 340/573.4, 534, 825.69, 825.72, 537, 531, 825.36, 527, 529; 109/38; 455/404, 38.2, 507

[56] References Cited

U.S. PATENT DOCUMENTS

| | | | |
|---|---|---|---|
| 4,157,540 | 6/1979 | Oros | 340/539 |
| 5,223,818 | 6/1993 | Polo | 340/574 |
| 5,568,126 | 10/1996 | Andersen et al. | 340/574 |

*Primary Examiner*—Julie Lieu
*Attorney, Agent, or Firm*—Bacon & Thomas

[57] ABSTRACT

An alarm system includes a trigger unit, a recognition unit, and an alarm unit. The trigger unit is operated by the user to output a radio wave to the recognition unit upon an emergency, causing the recognition unit to output a radio signal in triggering the alarm unit to output an alarm signal to the outside, asking for help.

2 Claims, 6 Drawing Sheets

ALARM SYSTEM

BACKGROUND OF THE INVENTION

The present invention relates to alarm systems, and more particularly to such an alarm system specifically designed for use in a bank, supermarket etc.

Regular alarm systems designed for use in banks, supermarkets, etc., must be operated manually. These alarm systems are commonly controlled by an alarm control button, which is fixedly mounted in a particular place. However, during an emergency, for example, encountering a robbery, workers at the site may be unable to approach the alarm control button. Further, when the alarm system in a bank, supermarket, etc., is triggered to produce an audio or visual alarm signal, the robber(s) may be infuriated and treat the persons at the site with violence.

SUMMARY OF THE INVENTION

It is one object of the present invention to provide an alarm system which can easily be controlled by the user to output a radio signal to trigger alarm means in a secret manner. It is another object of the present invention to provide an alarm system which has means to recognize the radio signal, and to prevent an error. An alarm system according to the present invention comprises a trigger unit, a recognition unit, and an alarm unit. The trigger unit arid the recognition unit are preferably mounted on the user's legs and waist. During an emergency, the user can operate the trigger unit by leg to output a radio wave to the recognition unit. When the radio wave is recognized, the recognition unit immediately outputs a radio signal to the alarm unit, causing the alarm unit to output a signal to the outsides for help. In order to prevent interference the trigger unit, the recognition unit and the alarm unit are designed to provide a particular code for recognition.

DETAILED DESCRIPTION OF THE PREFERRED EMBODIMENT

Figure 1:
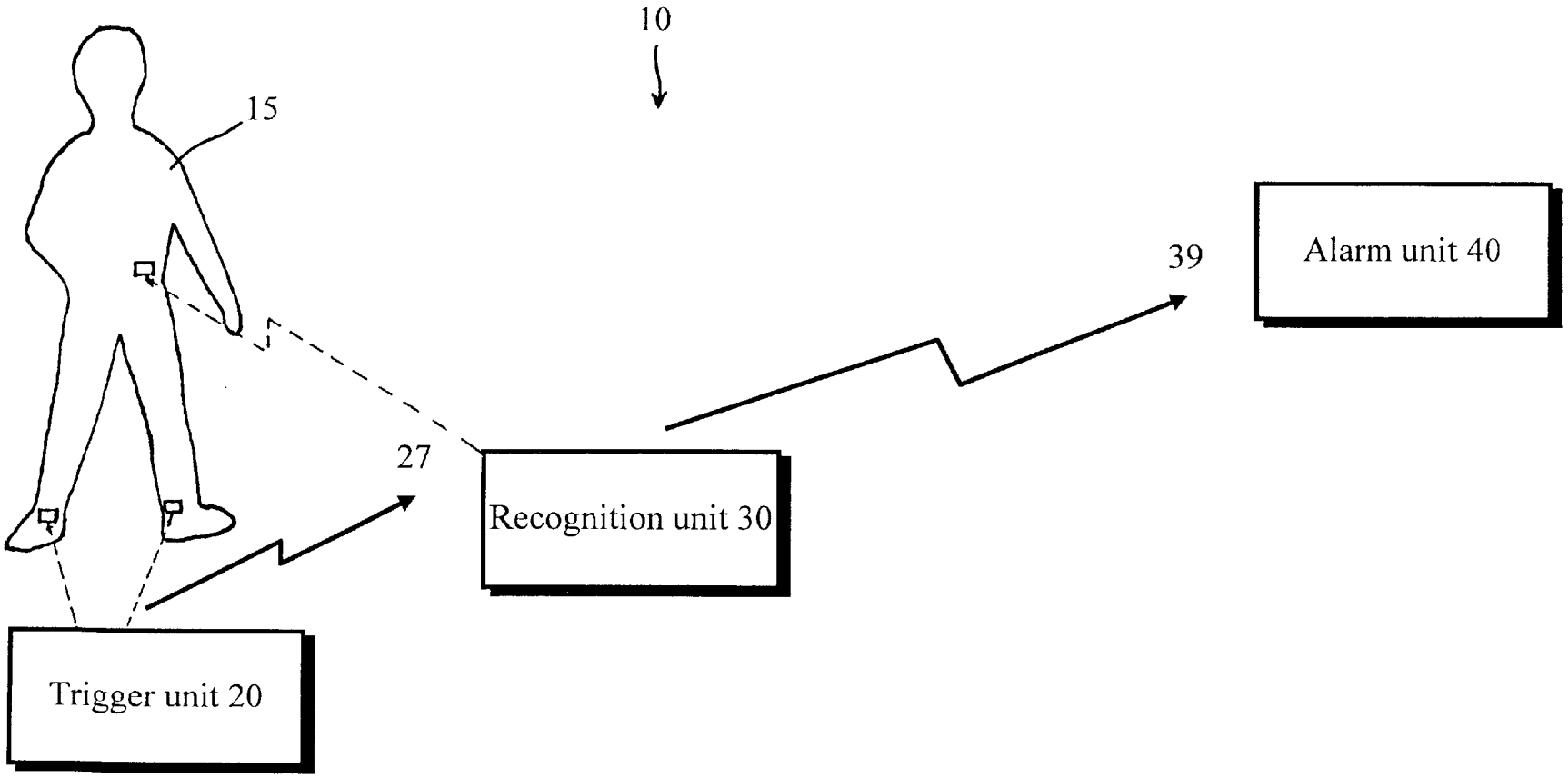
FIG. 1 is a system block diagram of an alarm system according to the present invention.

Referring to FIG. 1, an alarm system 10 is comprised of a trigger unit 20, a recognition unit 30, and an alarm unit 40. When the user is in an emergency, he (she) can then operate the trigger unit 20 to transmit a radio wave to the alarm unit 40, causing the alarm unit 40 to output an alarm signal.

Figure 2:
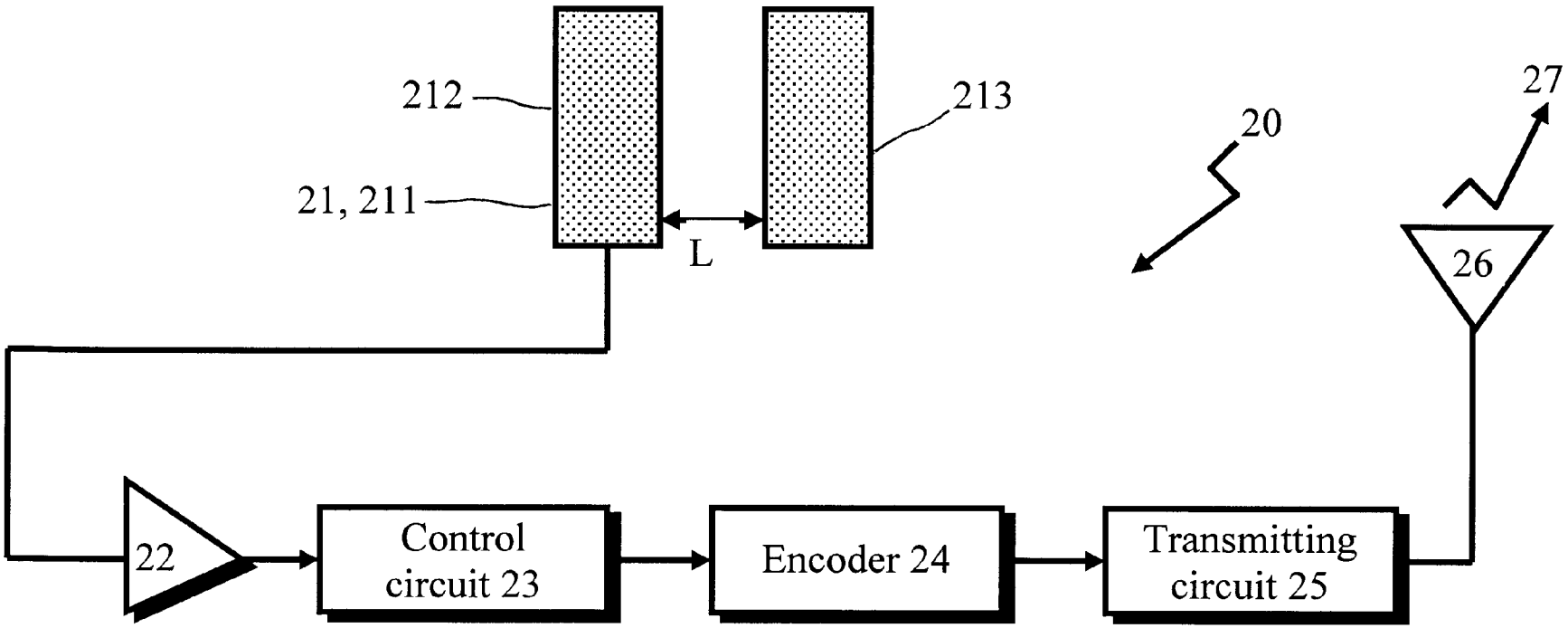
FIG. 2 is a circuit block diagram of the trigger unit of the alarm system according to the present invention.
Figure 5:
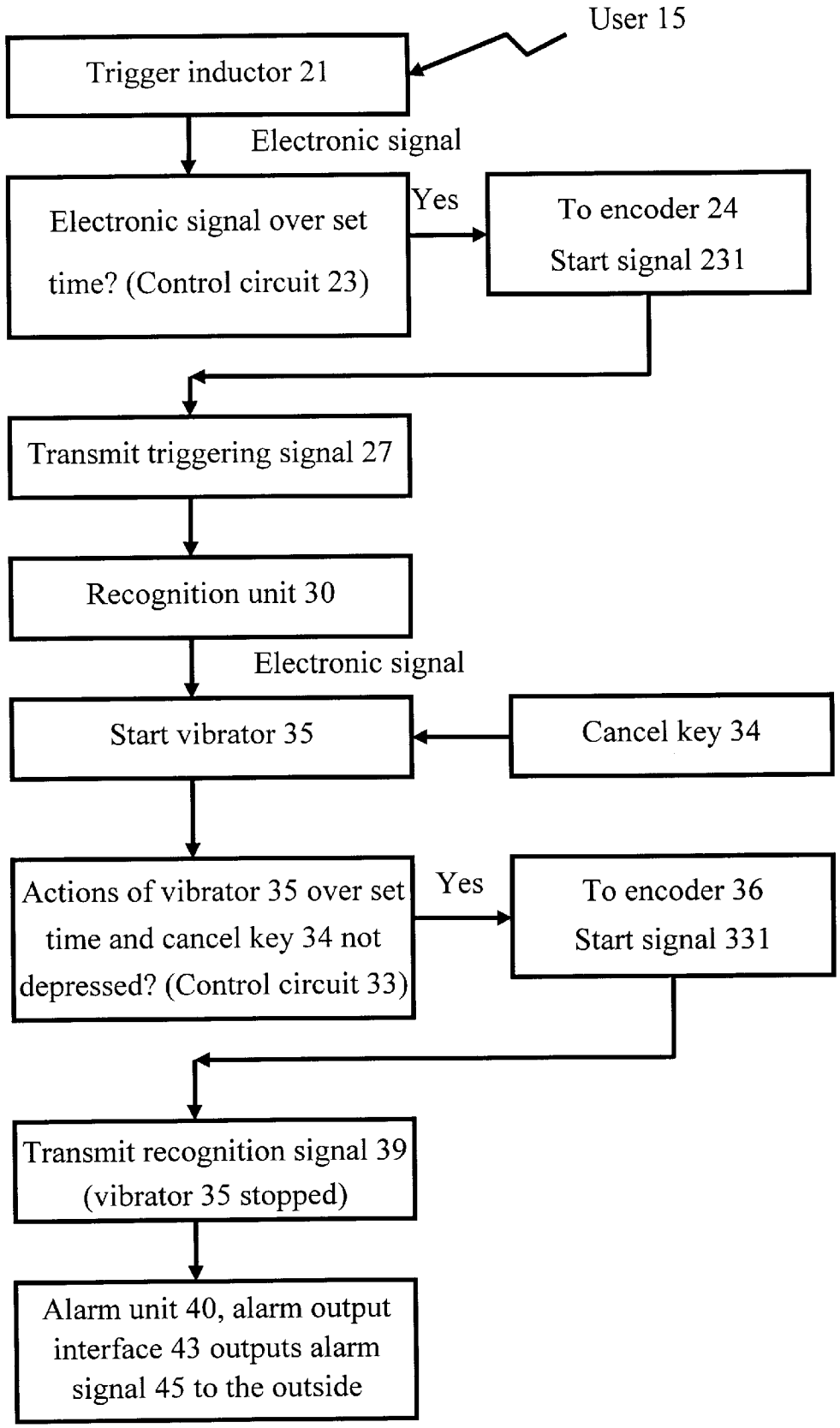
FIG. 5 is an operational flow chart of the alarm system according to the present invention.

Referring to FIGS. 2 and 5 and FIG. 1 again, the trigger unit 20 comprises an inductor 21, a signal amplifier 22, a control circuit 23, an encoder 24, a modulating and transmitting circuit 25, and an antenna 26. The trigger unit 20 is carried by the user 15. For example, the trigger unit 20 is mounted on the legs of the user 15. The inductor 21 can be a solenoid switch 211 (for example, CELDUC model AC11), comprised of a magnetic flux sensor 212 and a magnetic conductive element 213 respectively mounted on the left leg and the right leg. When the user 15 is in an emergency situation, the user can then move the legs toward each other. When the distance "L" between the legs is shorter than for example 2 centimeters, the magnetic flux sensor 212 is induced to output an electronic signal to the control circuit 23 through the signal amplifier 22.

Because the user 15 may move the legs toward each other when not in an emergency, the control circuit 23 must prohibit error signals from passing. For example, the control circuit 23 is set to output a start signal 231 only after the inductor 21 has been continuously outputting an electronic signal for more than 5 minutes. The start signal 231 from the control circuit 23 is encoded by the encoder 24 into a triggering signal 27, then demodulated into a radio signal by the modulating and transmitting circuit 25, and then transmitted by the modulating and transmitting circuit 25 into the air through the antenna 26.

Figure 3:
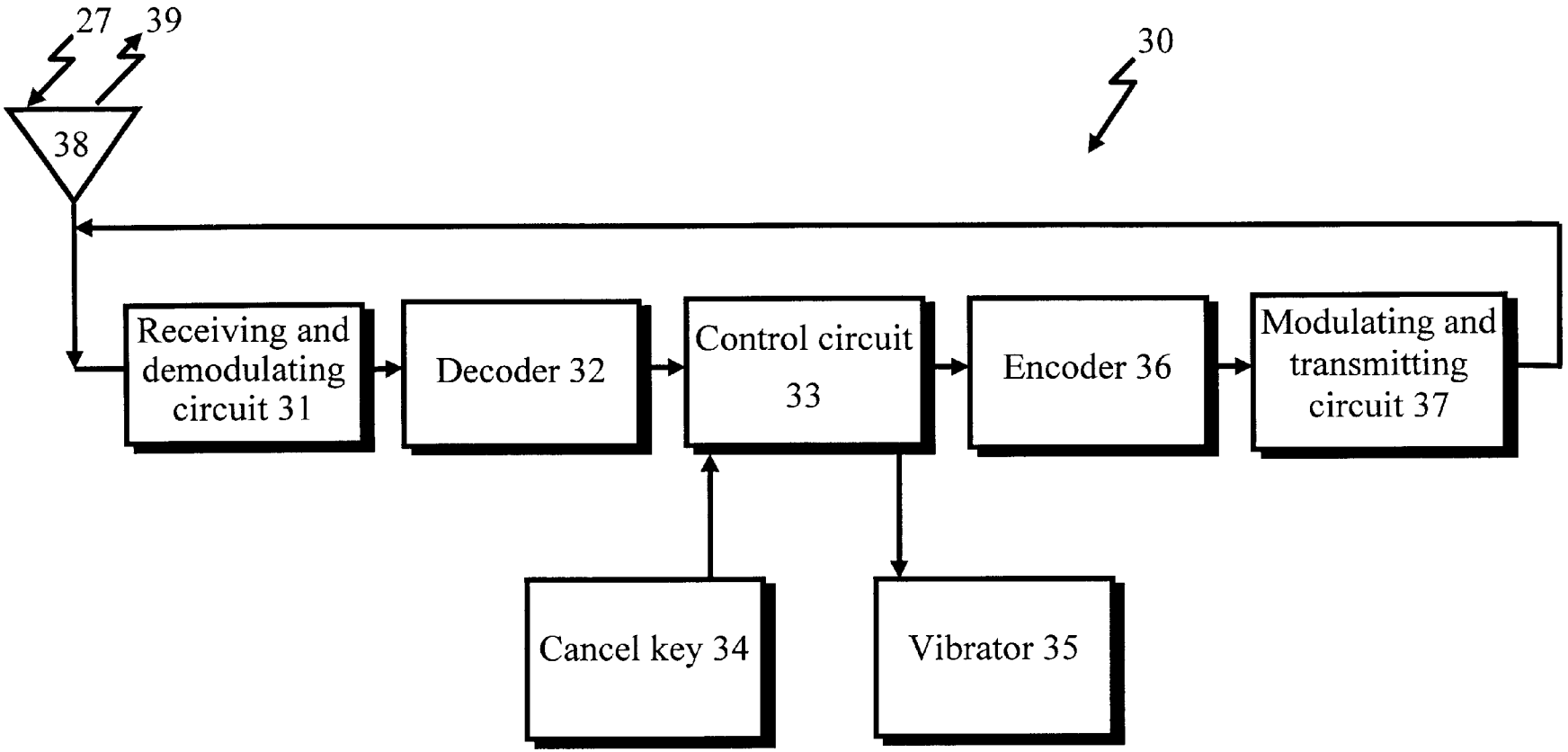
FIG. 3 is a circuit block diagram of the recognition unit of the alarm system according to the present invention.

Referring to FIG. 3, the triggering signal 27 from the trigger unit 20 is received by an antenna 38 of the recognition unit 30, then demodulated by a receiving and demodulating circuit 31, then decoded by a decoder 32, and then sent to a control circuit 33 for recognition. When the triggering signal 27 is recognized, the control circuit 33 immediately outputs an electronic signal to start a vibrator 35, causing it to vibrate. If the user clicks the cancel key, referenced by 34, within a predetermined length of time (for example 15 seconds) after starting of the vibrator 35, the electronic signal is canceled. If the vibrator 35 vibrates over the predetermined length of time (for example, 15 seconds), the control circuit 33 immediately outputs a start signal 331 to an encoder 36. The start signal 331 from the control circuit 33 is encoded by the encoder 36 into a recognition signal 39, then modulated by a modulating and transmitting circuit 37, and then transmitted into the air through the antenna 38 by radio.

Figure 4:
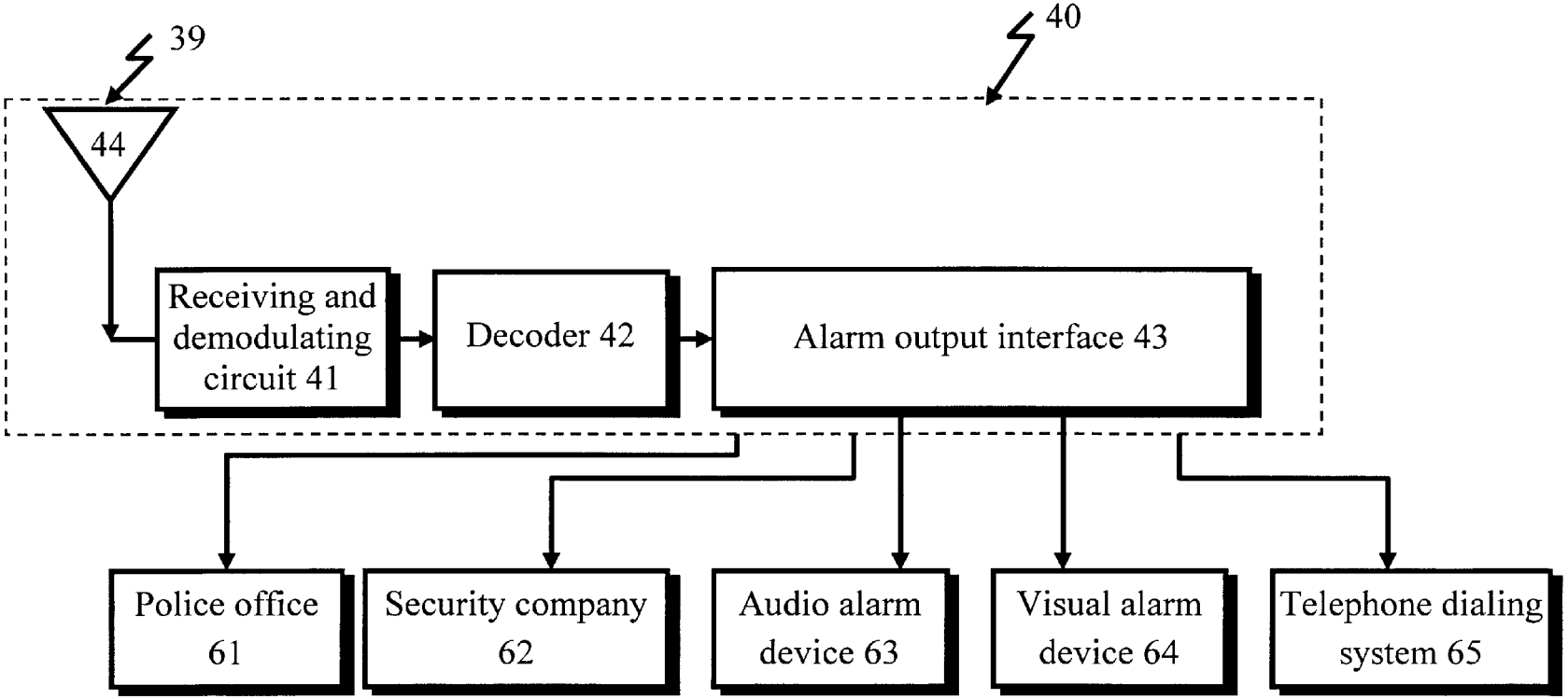
FIG. 4 is a circuit block diagram of the alarm unit of the alarm system according to the present invention.

Referring to FIG. 4 and FIG. 5 again, the recognition signal 39 from the recognition unit 30 is received by an antenna 44 of the alarm unit 40, then demodulated by a receiving and demodulating circuit 41 of the alarm unit 40, and then decoded by a decoder 42. When the recognition signal 39 is confirmed to be accurate after decoding, the decoder 42 outputs an electronic signal to an alarm output interface 43, causing it to output an alarm signal 45. The vibrator 35 is immediately stopped upon output of the alarm signal 45 from the alarm output interface 43, enabling the user to know the transmission of the alarm signal 45. The alarm output interface 43 can be connected to a police office 61, a security company 62, an audio alarm device for example a siren 63, a visual alarm device for example a flashing lamp 64, or an automatic telephone dialing system 65. If an automatic telephone dialing system 65 is installed and connected to the alarm output interface 43, the automatic telephone dialing system 65 can be set to dial a particular telephone number or a set of particular telephone numbers upon receipt of an output signal from the alarm output interface 43.

Figure 6:
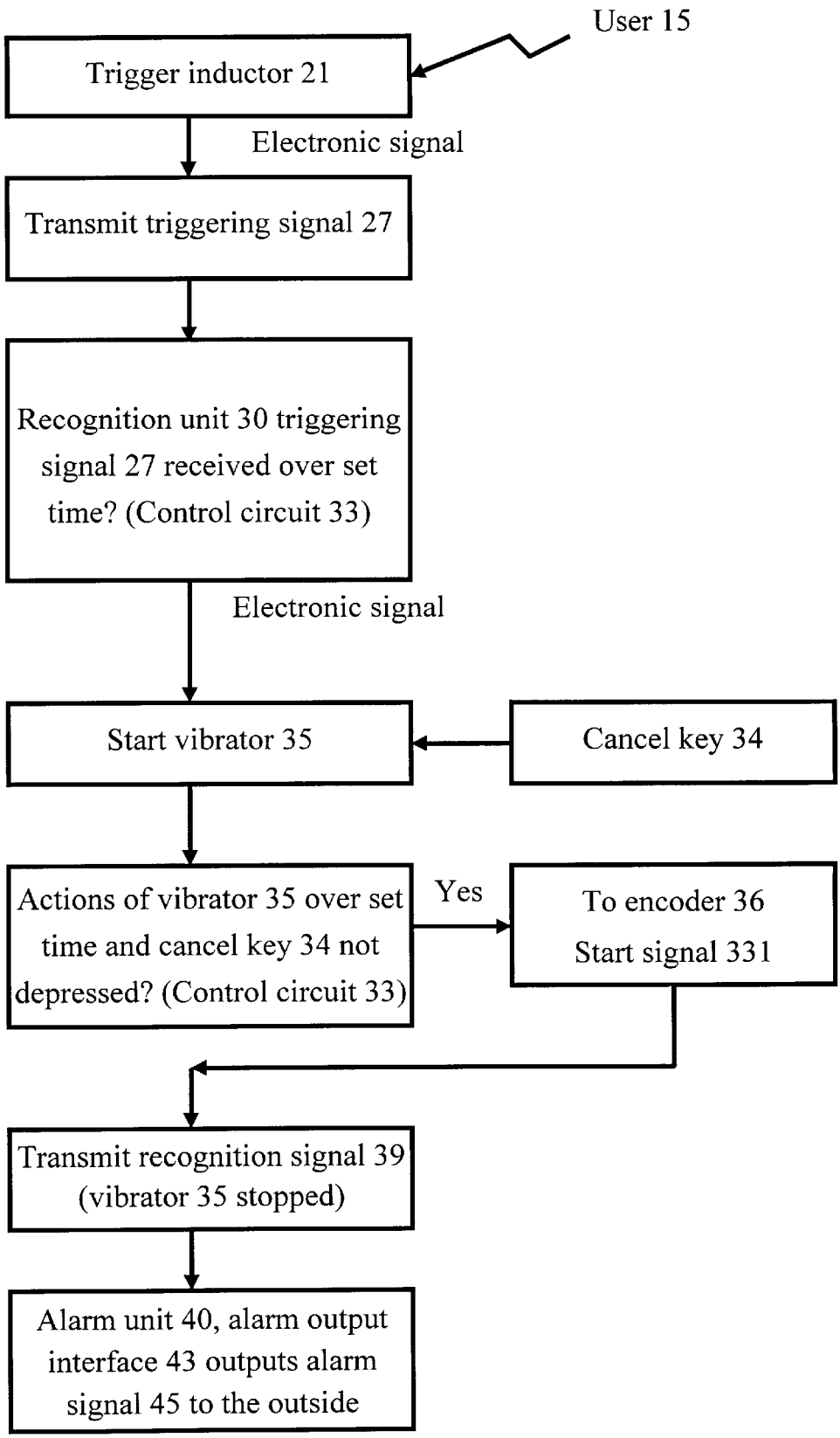
FIG. 6 is an operational flow chart of an alternate form of the alarm system according to the present invention.

FIG. 6 shows an alternate form of the present invention. According to this alternate form, the control circuit 23 of the trigger unit 20 controls the output of the start signal 231 immediately upon induction of the inductor 21 without any time delay; the control circuit 33 of the recognition unit 30 starts the vibrator 35 only when the triggering signal 27 has been continuously transmitted to the recognition unit 30 for a predetermined length of time (for example, 5 seconds). This design simplifies the design of the control circuit 23, and diminishes the size of the trigger unit 20.

Because the aforesaid encoders 24,32, decoders 32,42 and control circuits 23,33 can easily be achieved by conventional techniques, the related detailed circuit diagrams are not shown.

It is to be understood that the drawings are designed for purposes of illustration only, and are not intended as a definition of the limits and scope of the invention disclosed. For example, the control circuit 23 can have a complicated design such that the control circuit 23 outputs an electronic signal only after the magnetic flux sensor 212 and the magnetic conductive element 213 have been put in close proximity to each other over 5 seconds, then separated from each other over 3 seconds and then put in close proximity to each other over 6 seconds. This complicated design greatly reduces the possibility of the production of a false triggering signal. Of course the control circuits 23,33 can be comprised of a microprocessor for processing complicated data. The inductor 21 can be a push-button switch, which produces an electronic signal when depressed. The alarm unit 40 can be equipped with a radio transmitter circuit to transmit the alarm signal 45 into the air by radio.

What the invention claimed is:

1. An alarm system including an alarm apparatus activated selectively by a user, comprising:

(A) a trigger unit, said trigger unit comprising:

(a) an inductor operated by the user to produce an electronic signal, wherein said inductor comprises a first inductor mounted on a left leg of the user and a second inductor mounted on a right leg of the user and arranged so that when the user moves the left and right legs together so that the first inductor and second inductor are within a predetermined distance from each other, said electronic signal is produced;

(b) a control circuit arranged to output a start signal after receipt of the electronic signal from said inductor continuously for a predetermined time;

(c) an encoder arranged to receive and encode the start signal from the control circuit of said trigger unit into a triggering signal;

(d) a modulating and transmitting circuit arranged to modulate said triggering signal from said encoder;

(e) an antenna arranged to transmit said modulated triggering signal;

(B) a recognition unit, said recognition unit comprising:

(a) an antenna arranged to receive said modulated triggering signal from said trigger unit;

(b) a receiving and demodulating circuit arranged to receive and demodulate said modulated triggering signal from said antenna of said recognition unit;

(c) a decoder arranged to receive and decode signals from said receiving and demodulating circuit of said recognition unit and to output an electronic triggering recognition signal upon recognition of triggering signal from said recognition unit;

(d) a vibrator arranged to produce vibrations after the electronic triggering recognition signal from said decoder of said recognition unit is produced;

(e) a cancel key arranged to stop said vibrator from vibration when depressed by the user;

(f) a control circuit connected to said decoder, said cancel key and said vibrator of said recognition unit, said control circuit being arranged to output a start signal after said vibrator has been activated for a predetermined length of time;

(g) an encoder connected to said control circuit of said recognition unit to receive and recognize said start signal from said control circuit of said recognition unit and to output a start recognition signal corresponding to said start signal received; and (h) a modulating and transmitting circuit connected to said encoder of said recognition unit to modulate said start recognition signal into a radio signal and then to transmit the modulated radio signal through the antenna of said recognition unit; and (C) an alarm unit, said alarm unit comprising:

(a) an antenna arranged to receive said radio signal transmitted through the antenna of said recognition unit;

(b) a receiving and demodulating circuit arranged to receive and demodulate said radio signal received through the antenna of said alarm unit;

(c) a decoder arranged to decode and recognize the signal received from the receiving and demodulating circuit of said alarm unit and to output an alarm unit decoder electronic signal upon recognition of the start recognition signal from said recognition unit; and (d) an alarm output interface arranged to output an alarm signal to said alarm apparatus when receiving the alarm unit decoder electronic signal from the decoder of said alarm unit.

2. The alarm system of claim 1 wherein said inductor is a solenoid switch.

* * * * *